US009248564B1

(12) United States Patent
Ubeto

(10) Patent No.: US 9,248,564 B1
(45) Date of Patent: Feb. 2, 2016

(54) TOOTHBRUSH WITH COLLAPSIBLE HANDLE

(71) Applicant: German J. Ubeto, Miami Beach, FL (US)

(72) Inventor: German J. Ubeto, Miami Beach, FL (US)

( * ) Notice: Subject to any disclaimer, the term of this patent is extended or adjusted under 35 U.S.C. 154(b) by 0 days.

(21) Appl. No.: 14/554,921

(22) Filed: Nov. 26, 2014

(51) Int. Cl.
*B25G 1/04* (2006.01)
*A46B 5/00* (2006.01)
*A46B 15/00* (2006.01)

(52) U.S. Cl.
CPC . *B25G 1/04* (2013.01); *A46B 5/005* (2013.01); *A46B 15/0071* (2013.01); *A46B 15/0095* (2013.01)

(58) Field of Classification Search
CPC ..... A46B 5/005; A46B 15/0071; A46B 15/0095; B25G 1/04
See application file for complete search history.

(56) References Cited

U.S. PATENT DOCUMENTS 1,166,269 A * 12/1915 Smith ..... 15/184
1,646,082 A * 10/1927 Dailey ..... 132/309
2,641,012 A * 6/1953 Storrs ..... 15/144.4
3,188,675 A * 6/1965 Beck ..... 15/244.1
4,135,274 A * 1/1979 Freeman ..... 15/244.1
4,866,809 A * 9/1989 Pelletier ..... 15/167.1
6,726,011 B2 * 4/2004 Sarkar et al. ..... 206/362.1
2003/0080021 A1 5/2003 Kopecky
2004/0182733 A1 * 9/2004 Dunlap ..... 206/459.1
2004/0187241 A1 * 9/2004 Katz et al. ..... 15/144.4
2011/0041272 A1 * 2/2011 Prencipe et al. ..... 15/167.1

* cited by examiner

*Primary Examiner* — Randall Chin
(74) *Attorney, Agent, or Firm* — Spencer Fane LLP

(57) ABSTRACT

A compact toothbrush includes a head with a collapsible handle allowing it to be stored in a small sealed plastic package until used. Puncturing the seal of the packaging allows access to the sterile collapsed toothbrush therein. The toothbrush has a brush head with bristles extending from one side, and an opening containing one or more segments nested within one another forming a handle. The inner-most segment is pulled outward, away from the brush head, with the adjacent outer segments following. Upon extension the segments form an interference fit with each adjacent interior and exterior segment forming a rigid handle. A filament, such as dental floss is contained within the toothbrush. An end of the filament extends from the end of the handle opposite the brush head, and when the handle is extended a user can pull the filament from the toothbrush and use the filament to floss their teeth.

19 Claims, 14 Drawing Sheets

TOOTHBRUSH WITH COLLAPSIBLE HANDLE

BACKGROUND

The present disclosed subject matter relates generally to toothbrushes, and more particularly to a toothbrush with a collapsible handle.

Poor oral hygiene can cause disease of the oral cavity which affects other parts of the body, such as the digestive system and circulatory system. Brushing of the teeth and other tissues of the oral cavity can remove such disease causing elements and organisms. Full sized toothbrushes are suitable for use at home, however, such brushes can become their own source of problems if they are allowed to retain disease causing organisms. Small, disposable toothbrushes are available for single use for cleaning the teeth of the oral cavity. Such products include a small head with bristles and a small fixed handle packaged in a foil package. Once the disposable toothbrush is used the entire toothbrush is discarded.

SUMMARY

A toothbrush that is small in size includes a head with a collapsible handle allowing the compact toothbrush to be stored in a small sealed plastic package until used. Puncturing the seal of the packaging allows access to the sterile collapsed toothbrush therein. The collapsed toothbrush has a brush head with bristles extending from one side, and an opening containing one or more segments nested within one another. The inner-most segment is pulled outward, away from the brush head, with the adjacent outer segments following. The segments are nested within one another and upon extension form an interference fit with each adjacent interior and exterior segment thereby forming a rigid handle.

A filament, such as dental floss is contained within the toothbrush. An end of the filament extends from the end of the handle opposite the brush head, and when the handle is extended a user can pull the filament from the toothbrush and use the filament to floss their teeth.

In an embodiment, the inner most segment includes a conical member extending outward from the brush head providing structure for a user to grasp and for retaining the filament.

In an embodiment, the segments include a retention member that engages the end of each segment when the handle is in an extended configuration to prevent the collapse of the handle.

BRIEF DESCRIPTION OF THE DRAWINGS

The drawings constitute a part of this specification and include exemplary embodiments of the disclosed subject matter and illustrate various objects and features thereof.

DETAILED DESCRIPTION

Figure 1:
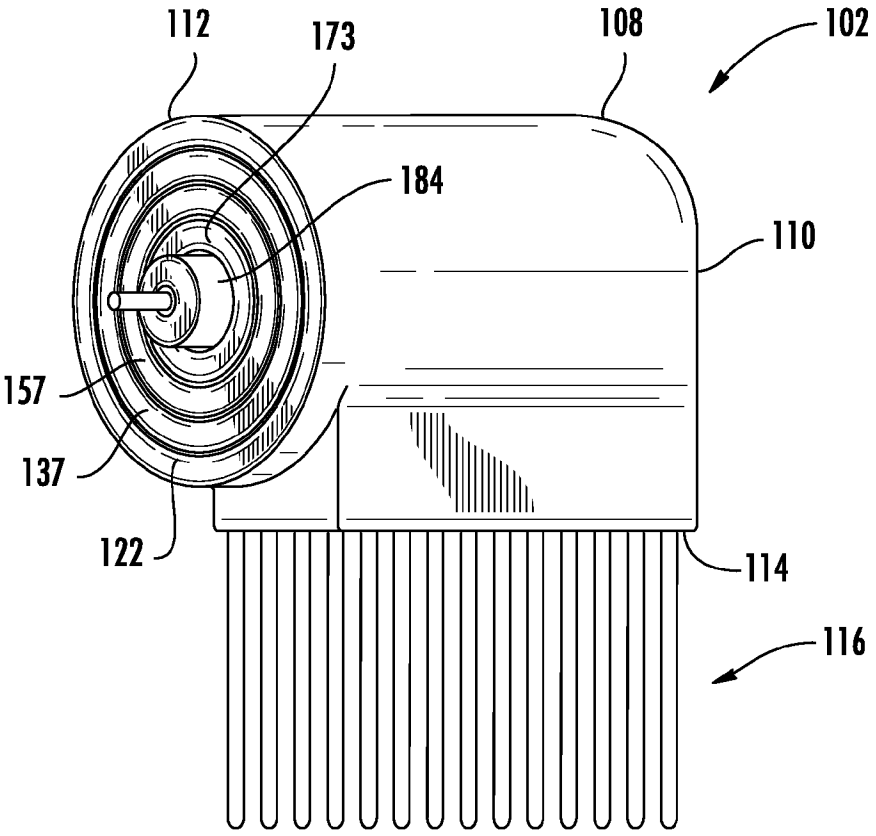
FIG. 1 is an isometric view of a toothbrush with a collapsible handle embodying principles of the disclosed subject matter with the handle in a collapsed configuration.
Figure 2:
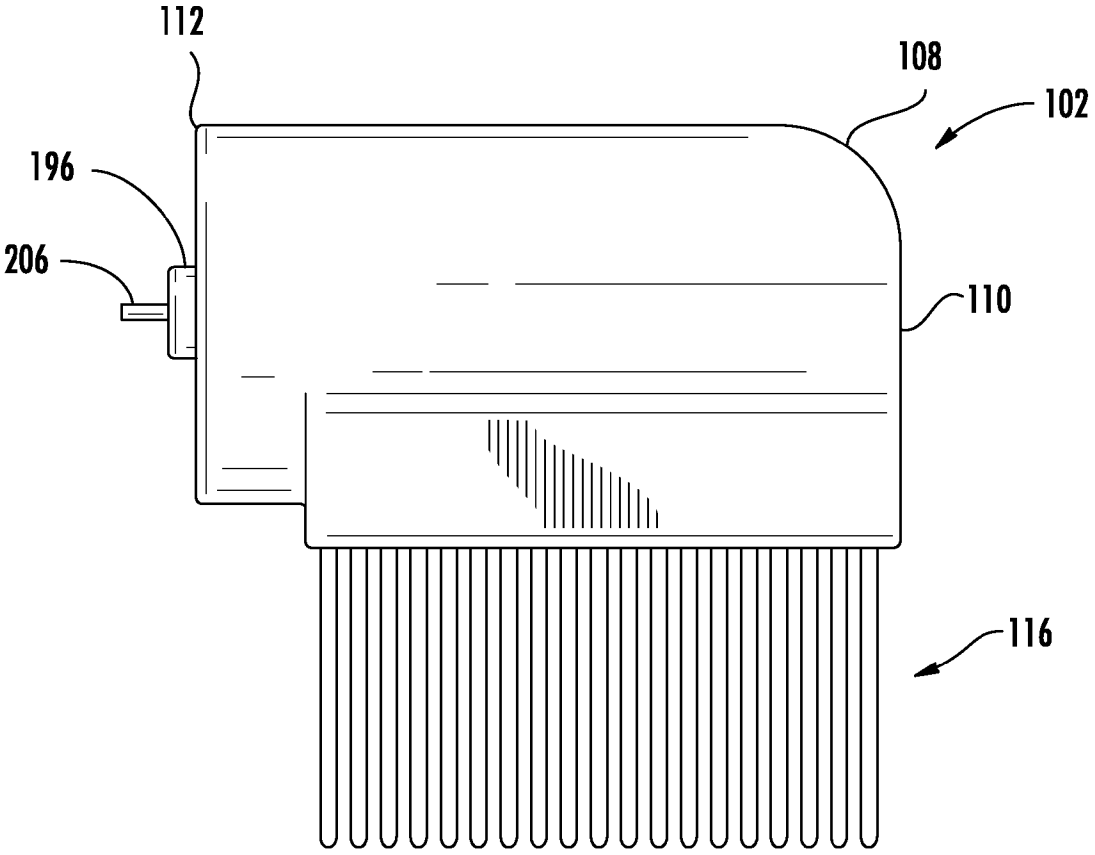
FIG. 2 is an elevation view of the toothbrush of FIG. 1.
Figure 3:
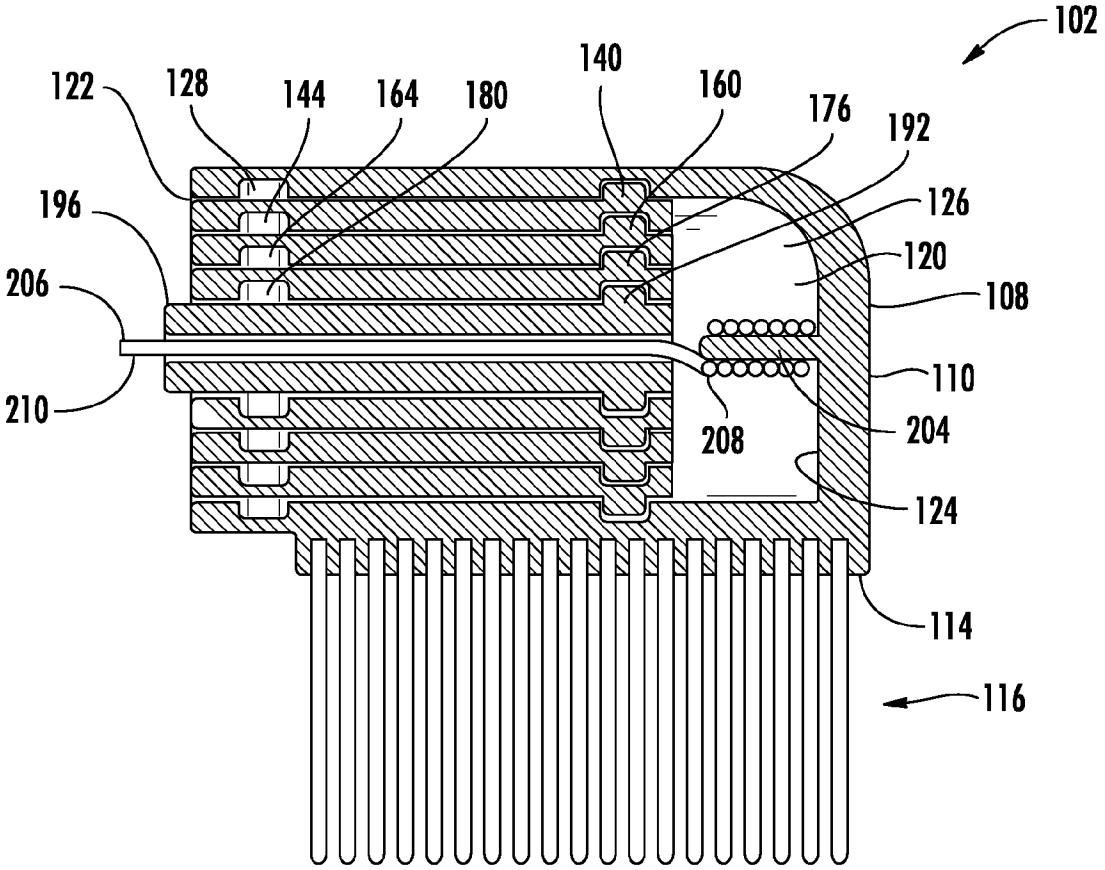
FIG. 3 is a cross-sectional view of the toothbrush of FIG. 2.
Figure 4:
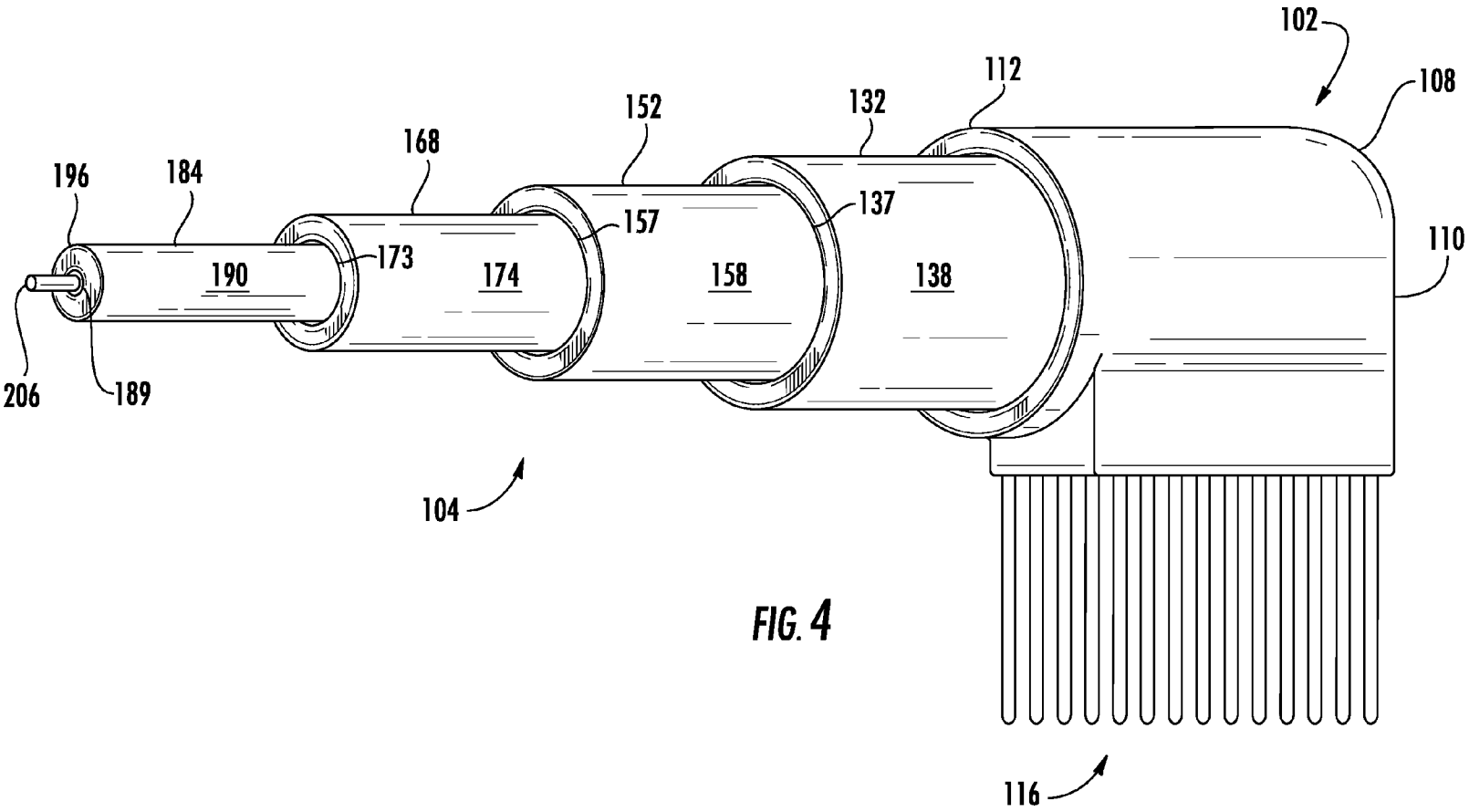
FIG. 4 is an isometric view of the toothbrush with the handle in an extended configuration.
Figure 5:
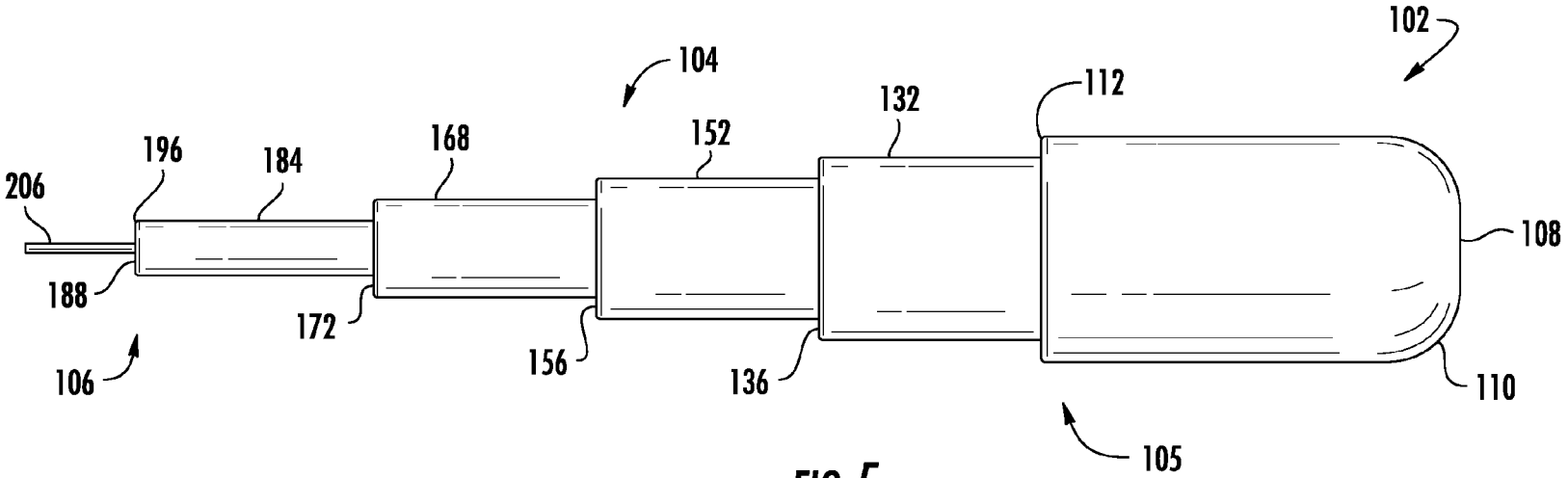
FIG. 5 is a top plan view of the toothbrush of FIG. 4.
Figure 6:
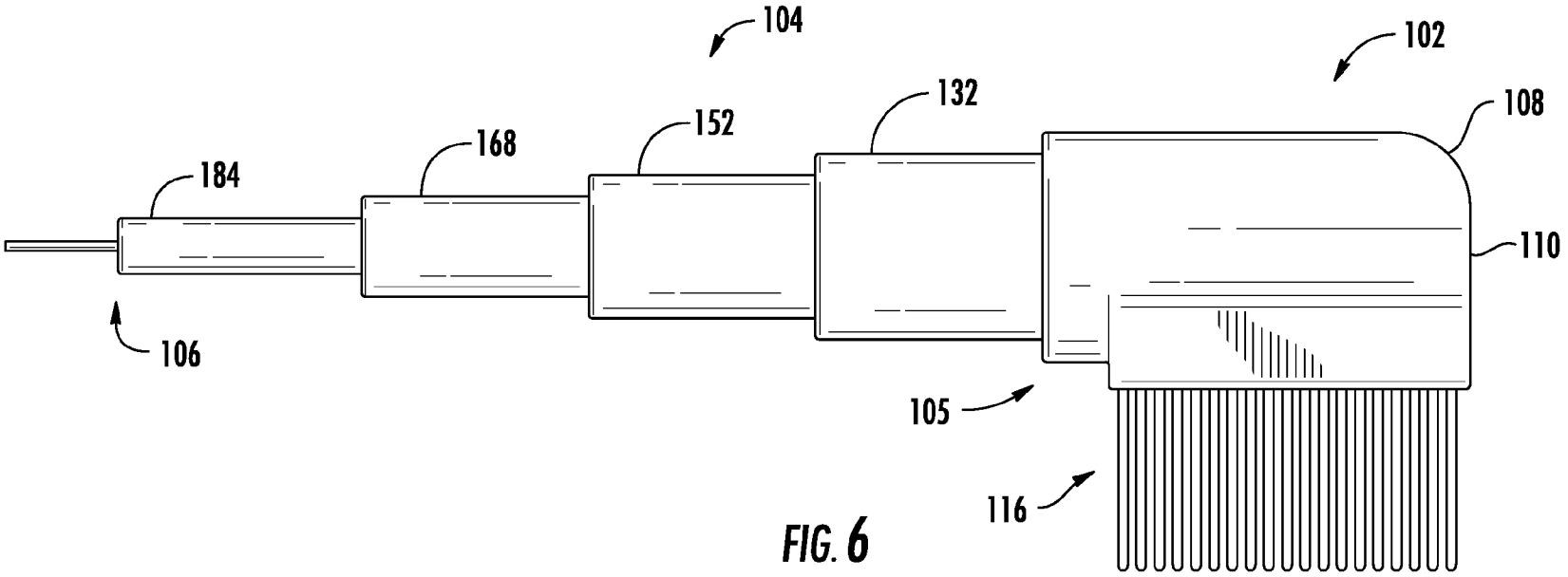
FIG. 6 is a side elevation view of the toothbrush of FIG. 4.
Figure 7:
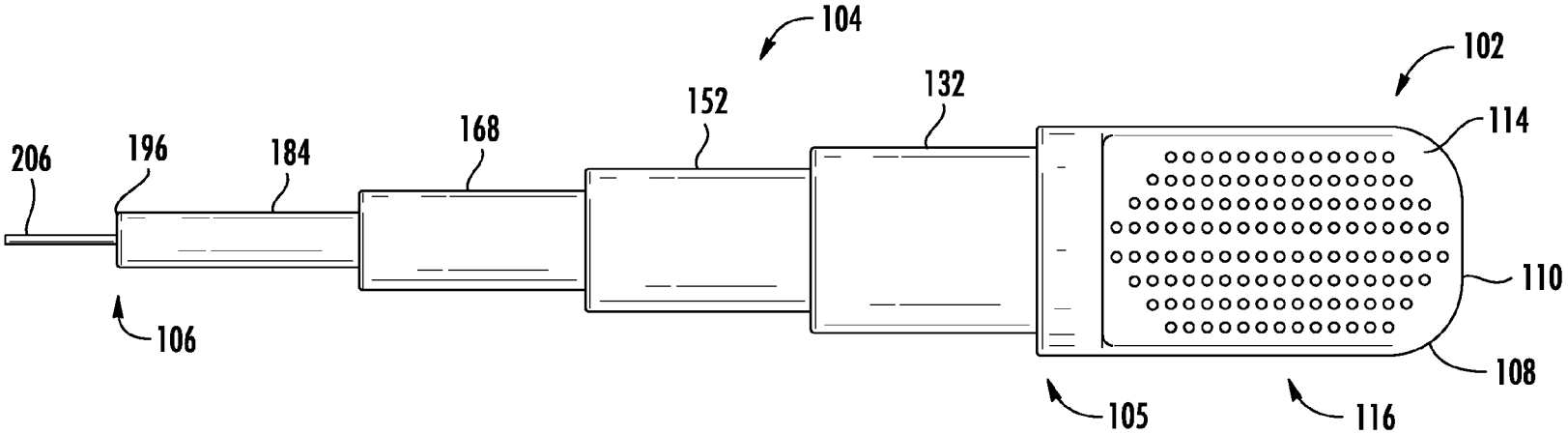
FIG. 7 is a bottom plan view of the toothbrush of FIG. 4.
Figure 8:
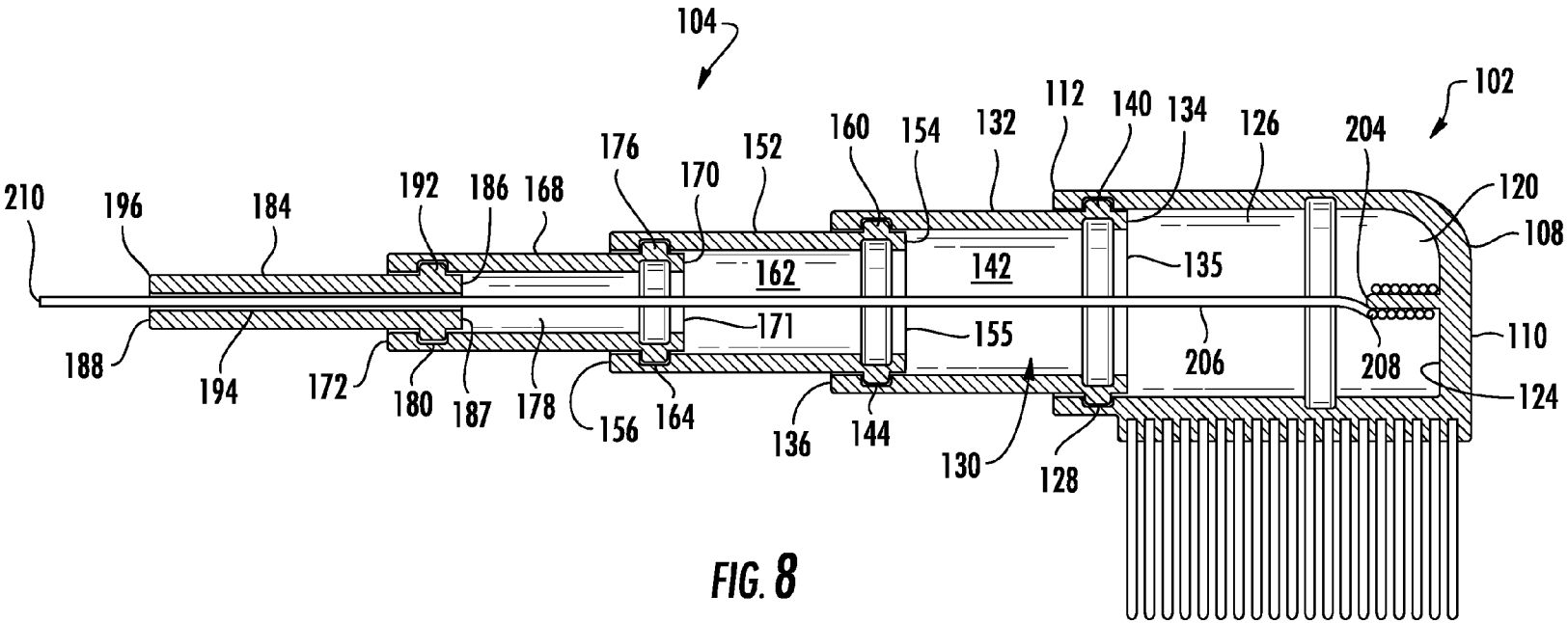
FIG. 8 is a cross-sectional view of the toothbrush of FIG. 6.

As required, detailed aspects of the disclosed subject matter are disclosed herein; however, it is to be understood that the disclosed aspects are merely exemplary of the disclosed subject matter, which may be embodied in various forms. Therefore, specific structural and functional details disclosed herein are not to be interpreted as limiting, but merely as a basis for the claims and as a representative basis for teaching one skilled in the art how to variously employ the disclosed technology in virtually any appropriately detailed structure.

Certain terminology will be used in the following description, and are shown in the drawings, and will not be limiting. For example, up, down, front, back, right and left refer to the disclosed subject matter as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

Referring to the drawings, FIGS. 1-8 show an embodiment of a cleaning device or toothbrush 102 embodying principles of the disclosed subject matter. The toothbrush 102 includes a brush head 108 and a collapsible toothbrush handle 104 for mechanical removal of debris and organisms from the oral cavity. The toothbrush 102 is portable and disposable providing a convenient instrument for a user to maintain optimal oral hygiene. In an embodiment, the head 108 is manufactured from molded plastic.

The head 108 is generally small in size and extends from a first end 110 to a second end 112 forming a cavity 120. In an embodiment, the head 108 includes an opening 122 at the second end 112 and an opening at the first end 110. In an embodiment, the cavity 120 is formed from a front wall 124 opposite an opening 122, and a sidewall 126 there between. The front wall 124 forms a stud 204 extending therefrom. The cavity 120 has an interior cross sectional dimension. An engagement member in the sidewall 126 adjacent the opening 122 receives a complimentary engagement member at the first end 134 of a first segment 132. In an embodiment, the head 108 engagement member is a recess or a groove 128 in the sidewall 126 adjacent the opening 122, and the complimentary engagement member at the first end 134 of the first segment 132 is a protrusion 140. In an embodiment, the groove 128 is an annular groove in the sidewall 126. A plurality of bristles 116 extend outward from a bottom face 114 at the exterior of the head 108 for scouring teeth in an oral cavity. In an embodiment, the bristles 116 are manufactured from nylon and are plugged into holes in the head 108. In an embodiment, the bristles 116 are formed from the head 108 from a resilient and soft thermoplastic elastomer. In an embodiment, the bristles 116 are combined with flavoring or toothpaste, such as by coating or impregnating the bristles 116.

The handle 104 comprises one or more segments formed from plastic that are nested within one another. The segments may have a circular, oblong, elliptical, flat, rectangular, or polyhedral cross-section, or a combination thereof. In an embodiment, the handle 104 comprises segments 132, 152, 168, and 184. The first segment 132 extends from a first opening 135 at a first end 134 to a second opening 137 at a second end 136, forming a tubular member with a wall having an exterior 138 and an interior 142. In an embodiment, the exterior 138 first end 134 includes an engagement member and the interior 142 second end 136 includes an engagement member. In an embodiment, the engagement member of the first end 134 is a protrusion 140 extending from the exterior 138, and the engagement member of the second end 136 is a groove 144 at the interior 142. In an embodiment, the groove 144 is an annular groove in the wall. The cross-sectional dimension of the first segment 132 has an exterior and interior dimension defined by the exterior 138 and interior 142, respectively. The exterior dimension of the first segment 132 generally conforms to the interior cross-sectional dimension of the cavity 120.

A second segment 152 extends from a first opening 155 at a first end 154 to a second opening 157 at a second end 156, forming a tubular member with a wall having an exterior 158 and an interior 162. In an embodiment, the exterior 158 first end 154 includes an engagement member and the interior 162 second end 156 includes an engagement member, wherein the engagement member at the first end 154 is complimentary to the engagement member at the second end 136. In an embodiment, the engagement member of the first end 154 is a protrusion 160 extending from the exterior 158, and the engagement member of the second end 156 is a groove 164 at the interior 162. In an embodiment, the groove 164 is an annular groove in the wall. The cross-sectional dimension of the second segment 152 has an exterior and interior dimension defined by the exterior 158 and interior 162, respectively. The exterior dimension of the second segment 152 generally conforms to the interior cross-sectional dimension of the first segment 132.

A third segment 168 extends from a first opening 171 at a first end 170 to a second opening 173 at a second end 172, forming a tubular member with a wall having an exterior 174 and an interior 178. In an embodiment, the exterior 178 first end 170 includes an engagement member and the interior 178 second end 172 includes an engagement member, wherein the engagement member at the first end 170 is complimentary to the engagement member at the second end 156. In an embodiment, the engagement member of the first end 170 is a protrusion 176 extending from the exterior 174, and the engagement member of the second end 172 is a groove 180 at the interior 178. In an embodiment, the groove 180 is an annular groove in the wall. The cross-sectional dimension of the third segment 168 has an exterior and interior dimension defined by the exterior 174 and interior 178, respectively. The exterior dimension of the third segment 168 generally conforms to the interior cross-sectional dimension of the second segment 152.

A terminal or fourth segment 184 extends from a first opening 187 at a first end 186 to a second opening 189 at a second end 188, forming a tubular member with an exterior 190 and an interior 194. In an embodiment, the exterior 190 first end 186 includes an engagement member and the second end 188 forms the end of the handle 196, wherein the engagement member at the first end 186 is complimentary to the engagement member at the second end 172. In an embodiment, the engagement member of the first end 186 is a protrusion 192 extending from the exterior 190. A protrusion 192 extends from the exterior 190 adjacent the first end 186. The cross-sectional dimension of the fourth segment 184 has an exterior and interior dimension defined by the exterior 190 and interior 194, respectively. The exterior dimension of the fourth segment 184 generally conforms to the interior cross-sectional dimension of the third segment 168.

In an embodiment, the segment protrusions are elements intermittently spaced around the circumference of the exterior. In another embodiment, the protrusion is a continuous band element circumscribing the exterior.

In use, the handle 104 is extended outwardly from the head 108 to span a length between a first end 105 to a second end 106. Prior to extension, the handle 104 is in a collapsed configuration (FIGS. 1-3), whereby the first segment 132 is nested within the brush head 108, the second segment 152 is nested within the first segment 132, the third segment 168, is nested within the second segment 152, and the fourth segment 184 is nested within the third segment 168 giving the handle a compact form. The handle 104 is transitioned between a collapsed configuration to an extended configuration by moving the segments away from the head 108. The extended handle 104 forms a passage 130 extending between the cavity 120 and the second end 188 of the fourth segment 184. In the collapsed configuration, the second end 188 of the fourth segment 184 extends beyond the second end 172 of the third segment 168 providing sufficient structure for a user to grasp the segment and move the fourth segment 184 away from the head 108, extending the handle 104. When the handle 104 is in an extended configuration (FIGS. 4-8), the segments interlock by an interference fit between the protrusions and grooves forming a stiff handle 104 allowing a user to manipulate the head 108 about the teeth within the oral cavity. In an embodiment, the protrusions are formed from a resilient material allowing the protrusions to compress or deform when the handle 104 is in a collapsed configuration, and return to a decompressed or non-deformed configuration when exposed to its corresponding groove. In the extended configuration, the second segment 152 first end 154 is disposed between the third segment 168 first end 170 and first segment 132 first end 134, the third segment 168 first end 170 is disposed between the terminal or fourth segment 184 first end 186 and second segment 152 first end 154. The handle 104 is returned to the collapsed configuration by moving the segments inwardly toward the head 108. In an embodiment, once the protrusions engage their corresponding grooves, the handle 104 cannot return to a collapsed configuration.

Figure 9:
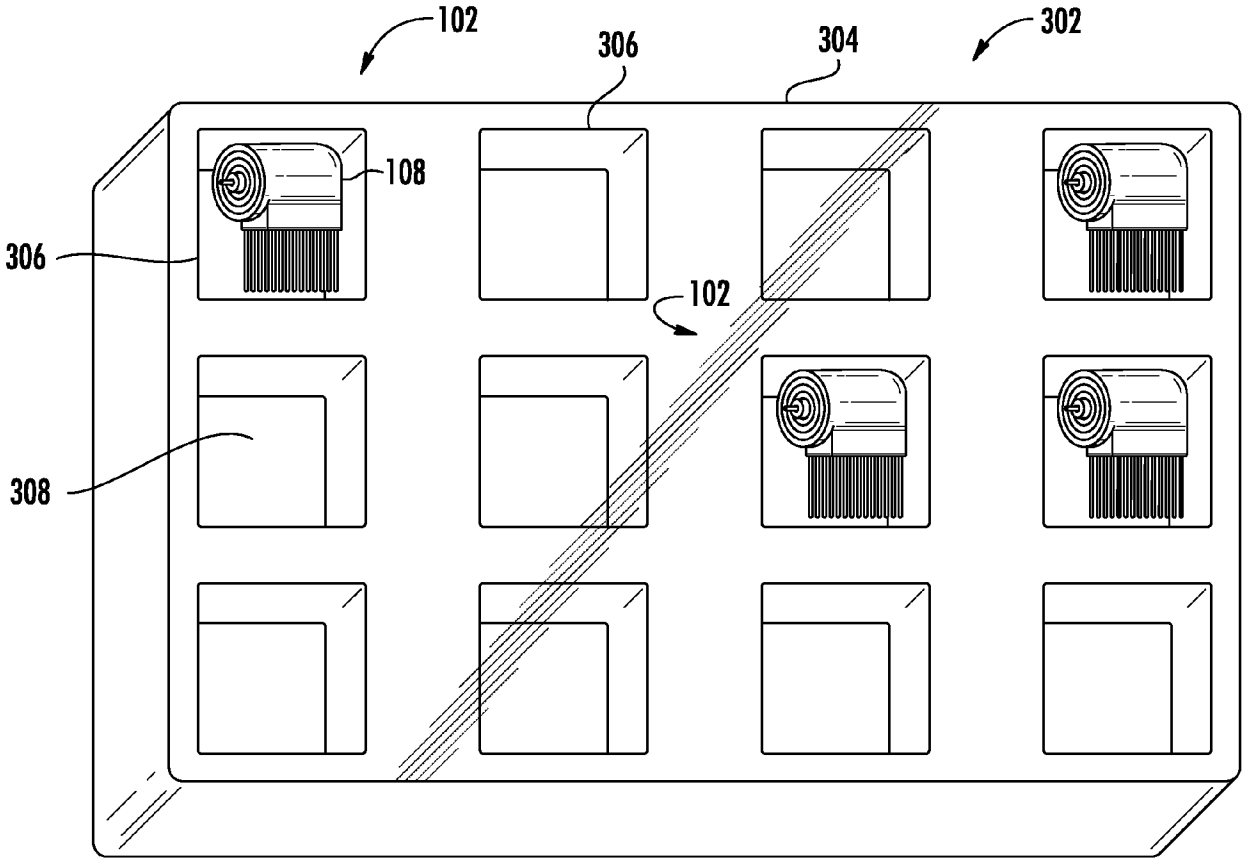
FIG. 9 is an isometric view of an embodiment of a package for dispensing the toothbrush with a collapsible handle.
Figure 10:
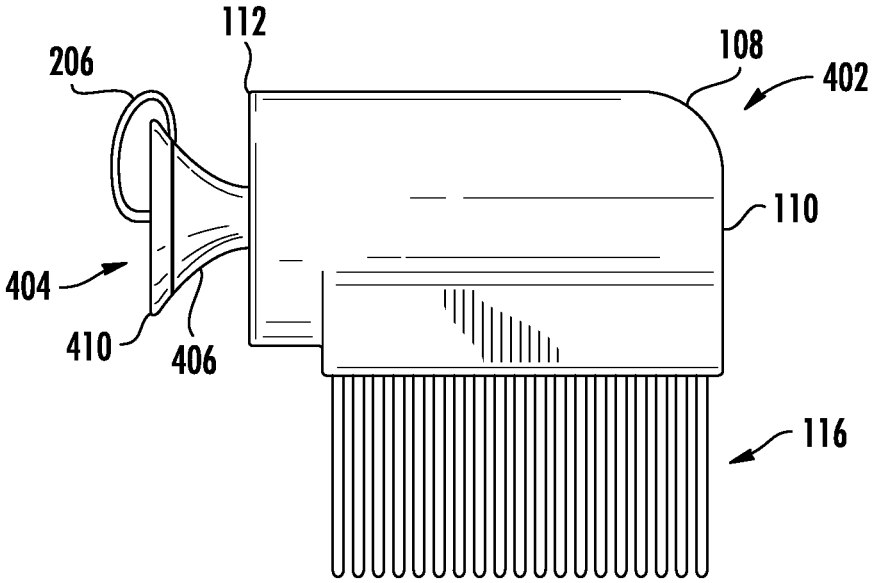
FIG. 10 is an elevation view of an alternative embodiment toothbrush with a collapsible handle embodying principles of the disclosed subject matter with the handle in a collapsed configuration.
Figure 11:
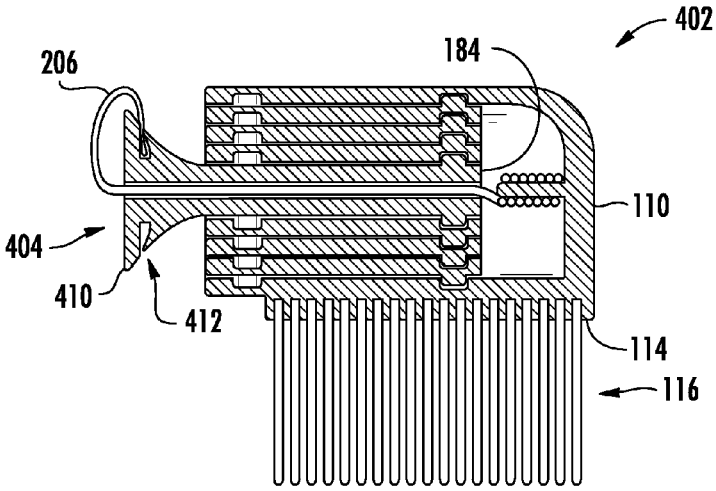
FIG. 11 is a cross-sectional view of the alternative embodiment toothbrush of FIG. 10.
Figure 12:
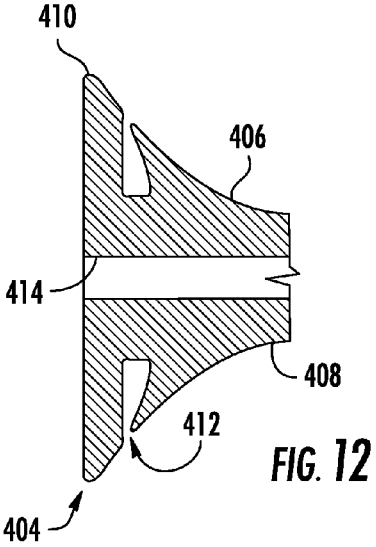
FIG. 12 is an enlarged cross-sectional view of the conical member.
Figure 13:
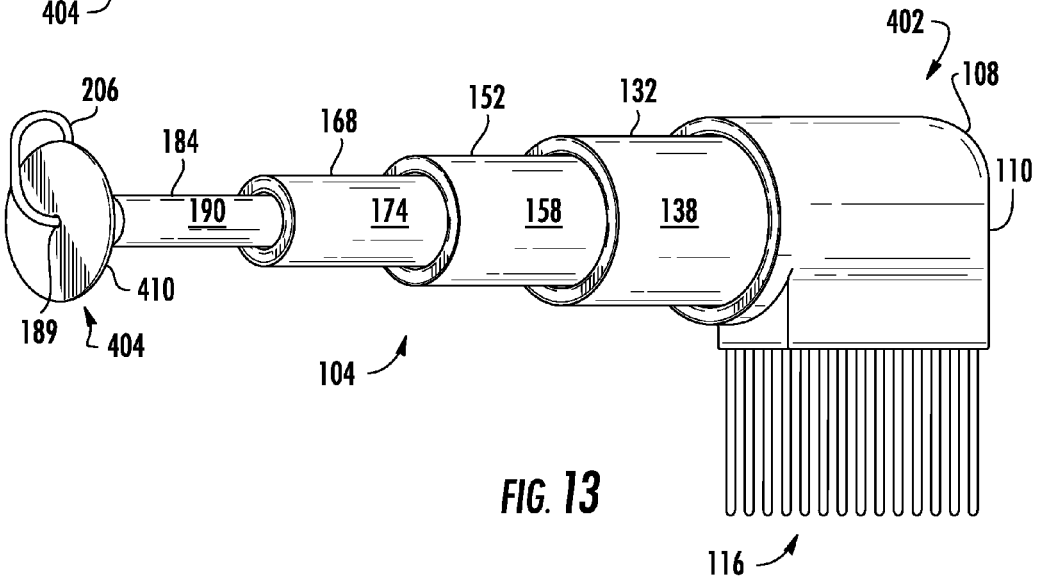
FIG. 13 is an isometric view of the alternative embodiment toothbrush with the handle in an extended configuration.

The toothbrush 102 can be stored in a package 302 until use. Referring to FIG. 9, the package 302 includes a tray 304 forming a plurality of compartments 306 sealed by a membrane 308. In an embodiment, a toothbrush 102 is sealed in a compartment 306 until use.

In an alternative embodiment, the toothbrush 102 includes a filament 206, including dental floss, for cleaning between the teeth of a user. In an embodiment, the filament 206 extends between a first end 208 within the handle to a second end 210 at the exterior 190 of the toothbrush 102. In an embodiment, the filament 206 extends from a first end 208 at the stud 204 to a second end 210 at the exterior 190 of the toothbrush 102. In an embodiment, the second end 210 is adhered to the exterior 190 of the terminal segment by an adhesive. When the toothbrush 102 is in a collapsed configuration a portion of the filament 206 is about the stud 204. Upon extension of the handle 104 the filament 206 extends from the stud 204 through the passage 130 to the exterior 190 of the fourth segment 184. In an embodiment, the filament 206 is wound around the stud. A user can grasp the second end 210 and pull the filament 206 off of the stud 204 separating the filament 206 from the toothbrush 102 for use when the toothbrush 102 is in either a collapsed configuration or an extended configuration.

In an embodiment, each engagement member and it's corresponding engagement member on the adjacent segment or head of the toothbrush 102, as the case may be, are complimentary in configuration.

In an embodiment, each groove and its corresponding protrusion of the toothbrush 102 are complimentary in conformation.

In an embodiment, the various grooves of the toothbrush 102 may be protrusions, and the various protrusions of the toothbrush 102 are complimentary grooves. For example, the groove 128 of the brush head 108 is a protrusion, and the protrusion 140 of the first segment is a groove complimentary of the brush head protrusions, providing an interference fit.

In an embodiment, the head 108 and segments do not have grooves, and the segments do not have protrusions; the various segments are nested within one another and the head 108 when the handle 104 is in a collapsed configuration, and the exterior wall first ends of each inner segment form an interference fit with the interior wall of its corresponding outer segment second end when the segments are moved outward away from the head 108 and the handle 104 is in an extended configuration.

Figure 14:
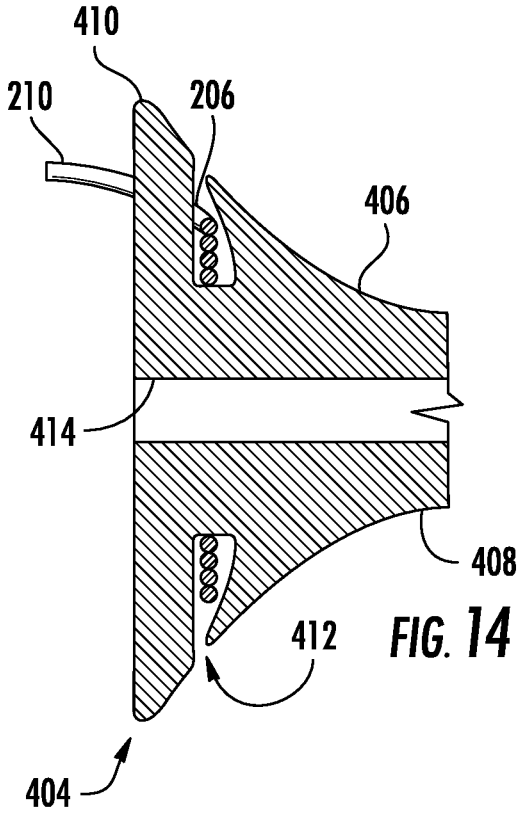
FIG. 14 is an enlarged cross-sectional view of the conical member with a filament wound around the core.

Referring to FIGS. 10-14, an alternative embodiment cleaning device or toothbrush 402 embodying principles of the disclosed subject matter is shown. The second end 188 of the terminal or fourth segment 184 forms a conical member 404 providing structure for a user to grasp the segment and move the fourth segment 184 away from the head 108. In addition, the conical member 404 allows attachment of the second end 210 of the filament 206. The conical member 404 includes a sidewall 406 extending outward from a narrow first end 408 to a broad circular second end 410. The sidewall 406 forms an annular groove 412 adjacent the second end 410 having a depth and a width for receiving the second end 210. The depth of the groove 412 terminates prior to the interior 194 forming a core 414 of material providing structural support to the conical member 404. In an embodiment, the width of the groove 412 provides an interference fit with the second end 210 of the filament 206. In an embodiment, the width of the groove 412 allows the filament 206 to be freely wound around the core 414. In an embodiment, the entirety of the filament 206 is wound around the core 414 and not retained within the brush head 108 or within the handle (FIG. 14).

Figure 15:
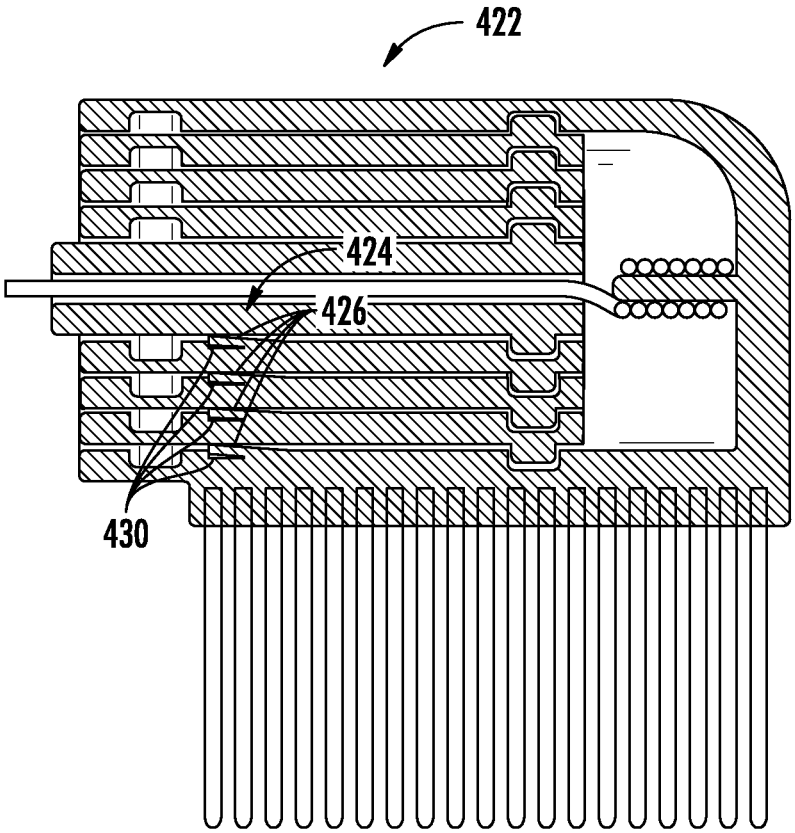
FIG. 15 is a cross-sectional view of an alternative embodiment toothbrush with a collapsible handle embodying principles of the disclosed subject matter with the handle in a collapsed configuration and the projections in a compressed configuration.
Figure 16:
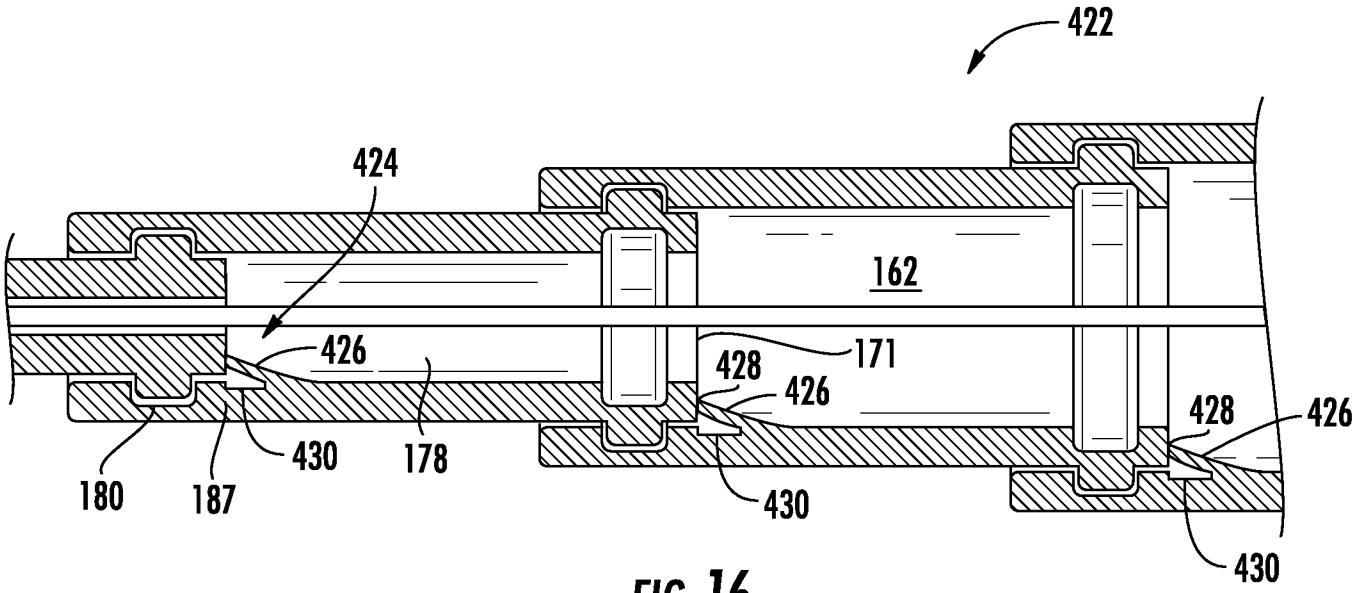
FIG. 16 is a cross-sectional view of the alternative embodiment toothbrush with the handle in an extended configuration and the projections in an uncompressed configuration.

Referring to FIGS. 15-16, an alternative embodiment cleaning device or toothbrush 422 embodying principles of the disclosed subject matter is shown. The interior sidewall of the brush head and interior wall of the segments include a retention member 424 comprising a projection 426 or barb that extends into the interior of the segment from a notch 430 for retaining the handle 104 in an extended configuration. Referring to FIG. 15, the handle 104 is shown in a collapsed configuration with notches 430 and projections 426 adjacent grooves 128, 144, 164, 180. In an embodiment, the interior wall forms the notch 430 and projection 426. The projection 426 has resilient qualities extends from a base to a tip 428 orientated toward the second end of the corresponding toothbrush 424 element. In an embodiment, brush head 108 and segments 132, 152, and 168 have one retention member 424. In an embodiment, the brush head 108 and segments 132, 152, and 168 have a plurality of retention members 424.

The notch 430 is dimensioned to receive the projection 426 when the projection 426 is in a compressed state. In FIG. 15 the projection 426 is in a partially compressed state. When the handle 104 is moved from the collapsed configuration (FIG. 15) to the extended configuration (FIG. 16), the protrusions seat within their respective grooves and the retention member 424 transitions from a compressed state to a decompressed state with the tip 428 extending into the passage 130 thereby preventing the handle 104 from being returned to the collapsed configuration. In an embodiment, an audible click sound is heard as the retention member 424 decompresses. As the first segment 132 is transitioned from a collapsed configuration to an extended configuration the protrusion 140 passes over a first retention member 424 and into the groove 128. When the first end 134 passes the tip 428 the projection 426 is no longer under compression and the tip 428 extends into the passage 130 and engages the first end 134 preventing the first segment 132 from being moved back into the brush head 108. As the second segment 152 is transitioned from a collapsed configuration to an extended configuration the protrusion 140 passes over a second retention member 424 and into the groove 144. When the first end 154 passes the tip 428 the projection 426 is no longer under compression and the tip 428 extends into the passage 130 and engages the first end 154 preventing the second segment 152 from being moved back into the first segment 132. As the third segment 168 is transitioned from a collapsed configuration to an extended configuration the protrusion 176 passes over a third retention member 424 and into the groove 164. When the first end 170 passes the tip 428 the projection 426 is no longer under compression and the tip 428 extends into the passage 130 and engages the first end 170 preventing the third segment 168 from being moved back into the second segment 152. As the terminal or fourth segment 184 is transitioned from a collapsed configuration to an extended configuration the protrusion 192 passes over a fourth retention member 424 and into the groove 180. When the first end 186 passes the tip 428 the projection 426 is no longer under compression and the tip 428 extends into the passage 130 and engages the first end 186 preventing the fourth segment 184 from being moved back into the third segment 168.

It will be appreciated that the collapsible toothbrush handle 104 can be used for various other applications. Moreover, the collapsible toothbrush handle 104 can be fabricated in various sizes and from a wide range of suitable materials, using various manufacturing and fabrication techniques.

It is to be understood that while certain aspects of the disclosed subject matter have been shown and described, the disclosed subject matter is not limited thereto and encompasses various other embodiments and aspects.

Having thus described the disclosed subject matter, what is claimed as new and desired to be secured by Letters Patent is:

1. An apparatus, comprising:

a cleaning device, comprising:

a hollow brush head, comprising:

an exterior face;

a plurality of bristles extending from the exterior face;

an internal sidewall; and an opening adjacent the sidewall;

at least one segment movably disposed within the brush head, comprising:

a tubular member with a wall having an exterior and an interior, the wall extending between a first opening at a first end and a second opening at a second end forming a passage;

a filament extending between a first end and a second end, wherein:

the first end is within the apparatus;

the second end is at the exterior of the apparatus; and wherein the filament extends from within the apparatus exiting the at least one segment at the second opening;

wherein when the at least one segment is in a first position the at least one segment is within the brush head; and wherein when the at least one segment is in a second position the exterior wall of the at least one segment forms an interference fit with the internal sidewall of the brush head opening.

2. The apparatus of claim 1, further comprising:

a groove within the brush head internal sidewall;

a protrusion extending from the at least one segment exterior adjacent the first opening; and wherein when the at least one segment is in the second position the at least one segment protrusion engages the brush head groove.

3. The apparatus of claim 2, wherein:

the groove is an annular groove; and the protrusion is an annular protrusion.

4. The apparatus of claim 2, wherein the groove within the brush head is complimentary in configuration to the protrusion of the at least one segment.

5. The apparatus of claim 1, further comprising:

a front wall within the brush head opposite the opening;

a stud at the front wall; and wherein the filament first end is at the stud.

6. The apparatus of claim 1, further comprising:

a first engagement member within the brush head internal sidewall;

a second engagement member at the at least one segment exterior adjacent the first opening; and wherein when the at least one segment is in the second position the first engagement member engages the second engagement member.

7. The apparatus of claim 6, wherein:

the first engagement member is a protrusion; and the second engagement member is a groove.

8. The apparatus of claim 1, further comprising:

a package, comprising:

a tray forming a compartment; and a membrane sealing the compartment;

wherein the cleaning device in the first position is sealed within the compartment.

9. The apparatus of claim 1, further comprising a retention member engaging the at least one segment in the second position preventing movement of the at least one segment into the brush head.

10. An apparatus, comprising:

a hollow brush head, comprising:

an exterior face;

a plurality of bristles extending from the exterior face;

an interior sidewall;

an opening in the brush head adjacent the sidewall face; and a first engagement member within the brush head adjacent the opening;

a first segment movably disposed within the brush head, comprising:

a tubular member with a wall having an exterior and an interior, the wall extending between a first end and a second end forming a passage;

a second engagement member at the exterior adjacent the first end;

a second segment movably disposed within the first segment, comprising:

a tubular member with a wall having an exterior and an interior, the wall extending between a first end and a second end forming a passage;

a filament extending between a first end and a second end, wherein:

the first end is within the brush head;

the second end is at the exterior of the apparatus; and wherein the filament extends from within the handle exiting the second segment at the second end;

a front wall within the brush head opposite the opening;

a stud at the front wall;

wherein the filament first end is at the stud;

wherein when the first segment is in a first position the first segment is within the brush head;

wherein when the second segment is in a first position the second segment first end is within the brush head;

wherein when the first segment is in a second position the first engagement member engages the second engagement member;

wherein when the second segment is in a second position the second segment first end is disposed between the first segment first end and first segment second end; and wherein when the first segment and second segment in the second positions form a handle assembly.

11. The apparatus of claim 10, wherein the bristles are formed from the brush head.

12. The apparatus of claim 10, further comprising:

a first retention member, comprising:

a notch in the interior sidewall of the brush head;

a projection extending from the notch into the interior of the brush head terminating at a tip;

wherein the first retention member tip engages the first segment first end when the first segment is in the second position.

13. A toothbrush, comprising:

a hollow brush head, comprising:

an exterior face;

a plurality of bristles extending from the exterior face;

an interior sidewall;

an opening in the brush head adjacent the sidewall face; and a first engagement member within the brush head adjacent the opening;

a first segment movably disposed within the brush head, comprising:

a tubular member with a wall having an exterior and an interior, the wall extending between a first opening and a second opening forming a passage; and a second engagement member at the exterior adjacent the first opening;

a terminal segment movably disposed within the first segment, comprising:

a tubular member with a wall having an exterior and an interior, the wall extending between a first opening and a second opening forming a passage;

a filament extending between a first end and a second end, wherein:

the first end is within the brush head;

the second end is at the exterior of the toothbrush; and wherein the filament extends from within the handle exiting the terminal segment at the second opening;

wherein when the first segment is in a first position the first segment is within the brush head;

wherein when the terminal segment is in a first position the terminal segment first opening is within the brush head;

wherein when the first segment is in a second position the first engagement member engages the second engagement member;

wherein when the terminal segment is in a second position the terminal segment first end is disposed outside the brush head; and wherein the first segment and terminal segment in the second positions form a handle assembly.

14. The toothbrush of claim 13, further comprising:

a front wall within the brush head opposite the opening;

a stud at the front wall; and wherein the filament first end is at the stud.

15. The toothbrush of claim 13, wherein:

the first engagement member is a recess; and the second engagement member is a protrusion.

16. The toothbrush of claim 15, wherein the bristles are received within holes in the exterior face.

17. The toothbrush of claim 13, wherein:

the first engagement member is a protrusion; and the second engagement member is a recess.

18. The toothbrush of claim 15, wherein the bristles are formed from the brush head.

19. The toothbrush of claim 13, wherein:

the terminal segment wall forms a conical member at the second opening, the conical member comprising:

a sidewall extending from a narrow first end to a broad circular second end; and wherein the sidewall forms an annular groove.

* * * * *